US006360407B1

(12) United States Patent
Webster et al.

(10) Patent No.: US 6,360,407 B1
(45) Date of Patent: Mar. 26, 2002

(54) SPRING STEEL DOOR HOLD-OPEN TOOL

(75) Inventors: Daniel T Webster, Sterling Heights; Brian W Kao, West Bloomfield; James R Carter, Casco; Brian A Hicks, Fraser, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/650,871

(22) Filed: Aug. 30, 2000

(51) Int. Cl.[7] ..... A44B 21/00; E05C 17/18

(52) U.S. Cl. ..... 24/570; 24/455; 24/545; 292/265; 292/267

(58) Field of Search ..... 24/570, 545, 455; 292/265, 267, DIG. 17

(56) References Cited

U.S. PATENT DOCUMENTS 1,140,852 A * 5/1915 Roeder ..... 292/267
1,615,035 A * 1/1927 Rasmussen ..... 292/265
2,002,738 A * 5/1935 Haug ..... 292/265
2,618,497 A * 11/1952 Gardels ..... 292/265
2,683,447 A * 7/1954 Pollock et al. ..... 292/265

* cited by examiner

*Primary Examiner*—Victor N. Sakran
(74) *Attorney, Agent, or Firm*—Mark P. Calcaterra

(57) ABSTRACT

A spring clip for releasably holding the door of a vehicle in an ajar position is provided. The spring clip is adapted to be removably attached to a vehicle body during the manufacturing process. The spring clip is comprised of a base member and a spring finger. The base member includes a pillar tab having a retainer that affixes the spring clip to the body of the vehicle. The door tab of the base member is adapted to slide into an opening in the door. The spring finger is coupled to a base opening that is defined by the base member. The spring finger extends in a cantilever fashion from the base opening into engagement with the vehicle door such that the door is held ajar.

15 Claims, 2 Drawing Sheets

SPRING STEEL DOOR HOLD-OPEN TOOL

BACKGROUND AND SUMMARY OF THE INVENTION

The present invention relates generally to vehicle manufacturing tools and more particularly to a spring clip for holding a door open during the manufacture of a vehicle.

During the manufacture and assembly of a vehicle various assemblies must be maintained in a known position to ensure the proper execution of succeeding steps in the process. Until recently, the doors of a finished vehicle were held in an open position by a detent position that is integral to the door hinges. Using a detent position within the door hinges resulted in undesirable squeaking as well as a limited number of stop positions. Therefore, most conventional vehicles now employ a check strap to provide several stop positions for a vehicle door. The check strap, which mounts between the door hinges from a vehicle pillar to the door, includes a pair of elongate bars sandwiched around a metal ball and a spring to provide multiple stop positions.

Although, a check strap provides desirable door operation, the strap complicates the assembly process of the vehicle due to the susceptibility of the spring and ball mechanism to some contaminants. The check strap may suffer degraded performance after exposure to assembly processes that involve applying or using substances that might infiltrate the check strap mechanism. For example, while applying paint to the vehicle, the doors are maintained in the open position exposing the check straps to contamination.

Therefore, it is an object of the invention to provide an inexpensive device that may be used to replace a check strap during the manufacture of a vehicle. Also, it is desirable for the device to maintain a vehicle door open during assembly. Additionally, it is an object to permit the vehicle door to be closed by applying a predetermined quantity of force to the door. Also, it is desirable for the device to be easily installed and removed.

To achieve the foregoing objectives a spring clip is provided for releasably holding the door of a vehicle in an ajar position. The spring clip is adapted to be removably attached to a vehicle body during the manufacturing process. The spring clip is comprised of a base member and a spring finger. The base member includes a pillar tab having a retainer that affixes the spring clip to the body of the vehicle. The door tab of the base member is adapted to slide into an opening in the door. The spring finger is coupled to a base opening that is defined by the base member. The spring finger extends in a cantilever fashion from the base opening into engagement with the vehicle door such that the door is held ajar.

The above described device is only an example. Devices in accordance with the present invention may be implemented in a variety of ways.

BRIEF DESCRIPTION OF THE DRAWINGS

These and other objects of the present invention, as well as the advantages thereof over other removable devices for maintaining a vehicle door in an open position will become apparent to those skilled in the art from the following detailed description in conjunction with the attached drawings.

DETAILED DESCRIPTION OF THE PREFERRED EMBODIMENT

Figure 1:
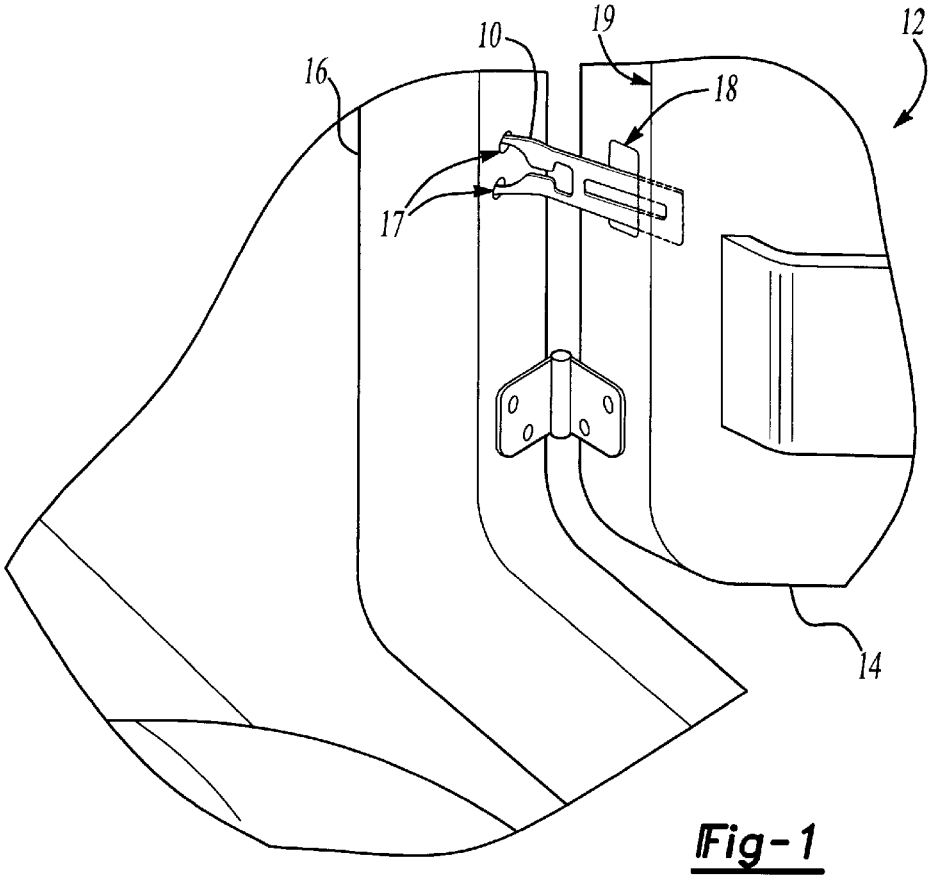
FIG. 1 is a perspective view of a presently preferred embodiment of the invention mounted to a vehicle.

Referring to FIG. 1, an exemplary spring clip 10 mounted to a vehicle 12 is illustrated. The spring clip 10 is used in place of a check strap (not shown) to hold a door 14 of the vehicle 12 in an open position during vehicle painting and other manufacturing processes. The clip 10 mounts between the door 14 and pillar 16 in place of the door check strap (not shown). One end of the spring clip 10 slides into a door opening 18 defined by the door 14 and rests against the inner surface 19 of the door 14. The other end of the spring clip 10 mounts to a set of holes 17 defined by the pillar 16. After completing the manufacturing processes that could degrade the performance of the check strap, the spring clip 10 is replaced with the check strap. In the finished vehicle, the check strap mounts between the door opening 18 and the set of holes 17 in the pillar.

Figure 2:
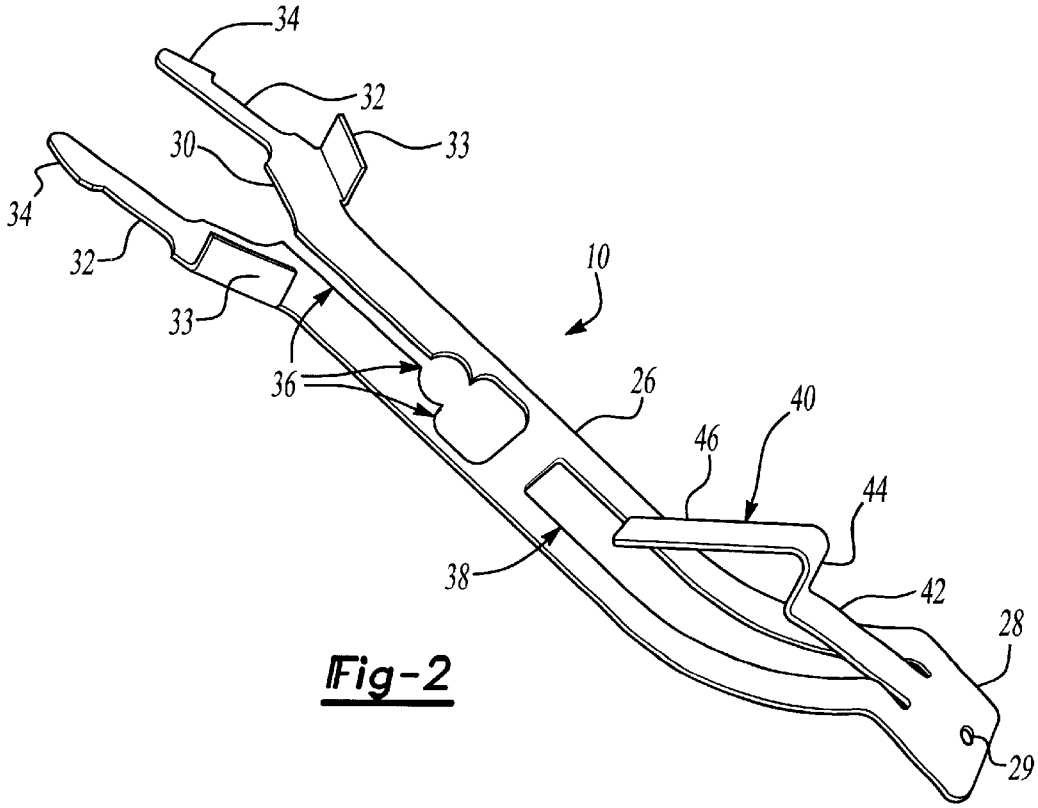
FIG. 2 is a perspective view of a presently preferred embodiment of the spring clip.

Referring to FIG. 2, a presently preferred embodiment of the spring clip 10 is shown. The spring clip 10 is preferably fabricated from a single piece of 1050 spring steel that is cut and stamped to form all the features of the clip 10. In the preferred embodiment the steel is heat-treated to a hardness of 45 Rockwell C. Although, the preferred embodiment employs a single piece design, the scope of the invention encompasses multi-piece designs.

The spring clip 10 includes a base member 26 having retention tabs at either end. A door tab 28 slides through the door opening 18 and lies against the inner surface 19 of the door. The door tab 28 is set at an angle of approximately 70 degrees to the base member 26 so that inside surface 29 of the door tab 28 lies flat against the inner surface 19 of the door. Although, the door tab 28 preferably lies flat against the inner surface of the door panel, it is within the scope of the invention to configure the clip 10 so that the door tab 28 lies at an angle to the door panel surface. As one skilled in the art would readily recognize, there are a multitude of possible orientations between a door and a door pillar. Therefore, instead of creating tools that are optimized for each orientation, it may be more desirable to create fewer tools that are usable with a range of orientations.

A pillar tab 30 extending from the other end of the base member 26 interfaces with the pillar holes 17. Included in the pillar tab 30 are two arms 32 extending therefrom for inserting into the pillar mounting holes 17. Although the preferred embodiment uses two arms for mounting to the pillar, it is within the scope of the invention to use other mounting structures such as a single arm, a downwardly facing arm, and a perpendicular arm. At the end of each pillar tab arm 32 is a retention barb 34 for securing the clip 10 to the pillar.

The base member 26 defines a flex opening 36 that is coupled to the pillar tab 30 for increasing the flexibility of the pillar tab 30 and the pillar tab arms 32. The flex opening 36 in the preferred embodiment is a slot extending from the pillar tab 30 and ending in a larger opening within the base member 26. The additional flexibility afforded by the flex opening 36 facilitates the insertion and removal of the spring clip 10 into the pillar mounting holes 17. Finger tabs 33 are affixed to the base member 26 to aid in the compression of the pillar tab 30 during installation and removal.

The base member 26 also defines a base opening 38 that extends from the door tab 28 toward the flex opening 36.

Preferably a support member separates the base opening 38 from the flex opening 36, however it is within the scope of the invention for a single opening to be defined extending from the door tab 28 to the pillar tab 30. A spring finger 40 for engaging the door 14 extends from the side of the base opening 38 nearest to the door tab 28. The spring finger 40 includes a cantilever portion 42 coupled to the base opening 38. Connected at approximately a 90 degree angle to the cantilever portion 42 is an engaging portion 44 that contacts the door 14 when the door 14 is in the ajar position. A retraction portion 46 extends from the engaging portion in a generally downward direction. The retraction portion 46 provides a path for the door opening 18 to traverse as the door 14 is opened.

To use the spring clip 10, the door 14 is first moved to the open position. The door tab 28 is then slid into the door opening 18 until the engaging portion 44 of the spring finger 40 contacts the door 14. The pillar tab 30 is then inserted into the pillar mounting holes 17. To close the door 14, pressure is applied to the door 14 until the spring clip 10 and spring finger 40 flex sufficiently to permit the engaging portion 44 to slide into the door opening 18. The spring finger retraction portion 46 prevents the door 14 getting caught up underneath the spring finger 40. When the door 14 is again moved to the open position, the retraction portion 46 slides along the edge of the door opening until the engaging portion 44 clears the door opening 18 and springs back into contact with the door 14.

Figure 3:
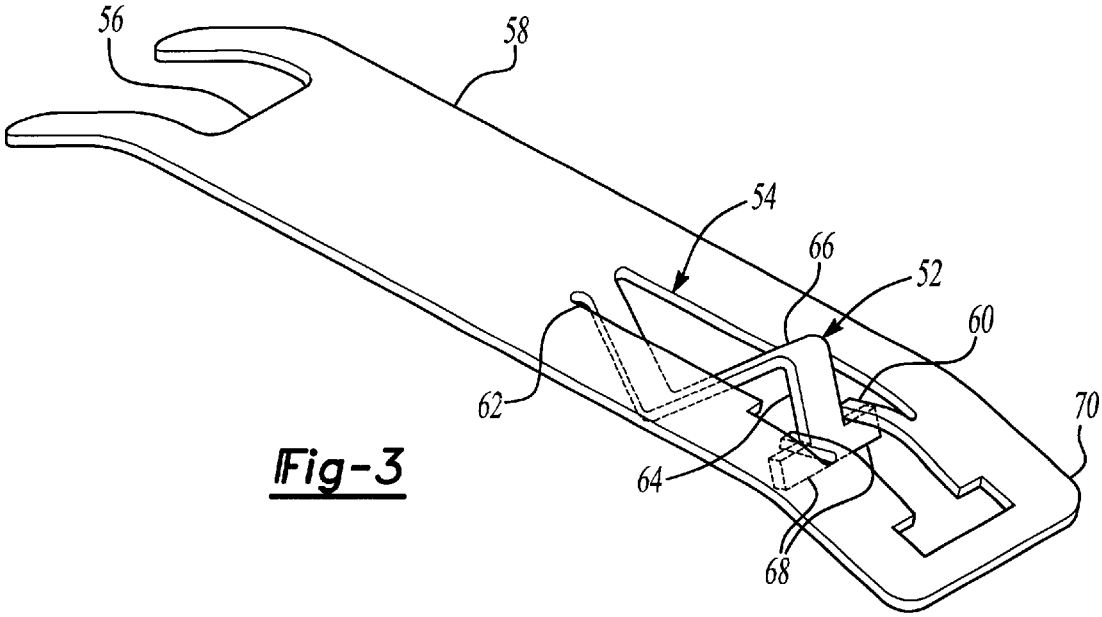
FIG. 3 is a perspective view of an embodiment of the spring clip in accordance with the principles of the invention.

Referring to FIG. 3, another embodiment in accordance with the present invention is illustrated. The spring clip 50 differs from spring clip 10 in that the spring finger 52 is coupled to the side of the base opening 54 nearest to the pillar tab 56. The base member 58 further includes a deflection guide 60 for guiding the motion of the spring finger 52. The spring finger 52 includes a cantilever portion 62 coupled to the side of the base opening 54. An engaging portion 64 is coupled to the cantilever portion 62 through a retraction portion 66. Guide arms 68 connect to the end of the engaging portion 64 to cause the spring finger 52 to deflect downward through the base opening as pressure is applied to the engaging portion. The deflection guide 60 extends outward from the side of the base opening 54 nearest to the door tab 70.

In operation, the door 14 is moved to the full open position, the door tab of the spring clip 50 is then inserted into the door opening 18 until the engaging portion 64 contacts the door 14. The pillar tab 56 is then inserted into the pillar mounting holes 17. When closing the door 14, force is applied to the engaging portion 64 by the door 14 causing the spring finger 52 to be pushed towards the pillar tab 56. The spring finger 52 is guided downward through the base opening 54 by the guide arms 68 riding along the deflection guide 60. The spring finger 52 continues to deflect downward until the engaging portion 64 passes through the door opening 18. The door then moves to the closed position. When the door is subsequently opened, the door edge rides along retraction portion 66 until the door clears the engaging portion. The spring finger 52 then springs back so that the engaging portion contacts the door 14.

Although certain preferred embodiments of the invention have been herein described in order to afford an enlightened understanding of the invention, and to describe its principles, it should be understood that the present invention is susceptible to modification, variation, innovation and alteration without departing or deviating from the scope, fair meaning, and basic principles of the subjoined claims.

What is claimed is:

1. A spring clip adapted to be removably attached to a vehicle body for releasably holding a vehicle door that defines a door opening in an ajar position, the spring clip comprising:

a base member including a pillar tab and a door tab at either end, the base member defining a base opening having two sides;

a spring finger coupled to a side of the base opening and extending in cantilever fashion into engagement with the vehicle door for holding the door ajar;

the pillar tab having a retainer for affixing the spring clip to the vehicle body; and the door tab being adapted to slide into the door opening.

2. The spring clip of claim 1 wherein the spring arm is coupled to the side of the base opening closest to the pillar tab of the base member.

3. The spring clip of claim 2 wherein the base member further includes a deflection guide; and the spring arm includes a first engaging portion for engaging the door opening and a guide arm for deflecting the spring arm in response to moving the door towards a closed position such that the first engaging portion passes through the door opening;

wherein, movement of the door towards a closed position causes the pillar tab of the base member to extend into the door opening such that the door engages the first engaging portion of the spring arm resulting in the spring arm deflecting so that the first engaging portion passes through the door opening.

4. The spring clip of claim 1 wherein the spring arm is coupled to the side of the base opening closest to the door tab of the base member.

5. The spring clip of claim 4 wherein the spring arm includes a cantilevered portion extending from the base member and a second engaging portion extending from the cantilevered portion;

wherein, when the vehicle door is ajar the base member extends into the door opening and the second engaging portion engages the vehicle door.

6. The spring clip of claim 1 wherein the pillar tab of the base member includes a retainer for affixing the body member to the vehicle body.

7. The spring clip of claim 6 wherein the retainer includes two elastically movable arms.

8. The spring clip of claim 6 wherein the retainer includes a separable retainer for affixing the body member to the vehicle body.

9. The spring clip of claim 1 wherein the base member pillar tab defines a flex opening for increasing the flexibility of the pillar tab.

10. The spring clip of claim 9 wherein the flex opening is a slot.

11. The spring clip of claim 9 wherein the flex opening is a slot with a substantially circular portion.

12. The spring clip of claim 1 wherein the base member is made of a resiliently yieldable material.

13. The spring clip of claim 1 wherein the base member door tab extends at an angle from the base member such that the door tab is approximately parallel to an inside surface of the door.

14. A spring clip adapted to be removably attached to a vehicle body for releasably holding a vehicle door in an ajar position, the spring clip comprising:

a base member having a body tab and a pillar tab and including a deflection guide, the base member defining a base opening having a pillar tab side and a door tab side;

a spring finger coupled to the pillar tab side of the base opening, the spring arm including a first engaging portion for engaging the door opening and a guide arm engaging the deflection guide for deflecting the spring arm in response to movement of the door towards a closed position such that the first engaging portion passes through the door opening the pillar tab having a retainer for affixing the spring clip to the vehicle body, the pillar tab further defines a flex opening for permitting flexure of the pillar tab; and the door tab being adapted to slide into the door opening;

wherein, movement of the door towards a closed position causes the door tab of the base member to extend into the door opening such that the door engages the first engaging portion of the spring arm resulting in the guide arm moving along the deflection guide, whereby the spring arm deflects so that the first engaging portion passes through the door opening.

15. A spring clip adapted to be removably attached to a vehicle body for releasably holding a vehicle door in an ajar position, the spring clip comprising:

a base member made of resiliently yieldable material having a pillar tab and a door tab, the base member defining a base opening having a pillar tab side and a door tab side;

a spring finger including a coupling portion coupled to the pillar tab side of the base opening, a first engaging portion extending from the coupling portion for engaging the door opening, wherein the spring arm in response to movement of the door towards a closed position flexes such that the first engaging portion passes through the door opening;

the pillar tab having a retainer for affixing the spring clip to the vehicle body, the pillar tab further defines a flex opening for permitting flexure of the pillar tab; and the door tab being adapted to slide into the door opening;

wherein, movement of the door towards a closed position causes the door tab of the base member to extend into the door opening such that the door engages the first engaging portion of the spring arm causing the spring arm to flex such that the first engaging portion passes through the door opening.

* * * * *